US008047526B2

(12) United States Patent
Ledford et al.

(10) Patent No.: US 8,047,526 B2
(45) Date of Patent: Nov. 1, 2011

(54) IN-LINE JUSTIFIER FOR LETTER AND FLAT MAIL SORTER

(75) Inventors: Sean B. Ledford, Perry Hall, MD (US); Pierre J. Campagnolle, Elkridge, MD (US); Laurent Buffat, Columbia, MD (US)

(73) Assignee: Northrop Grumman Systems Corporation, Los Angeles, CA (US)

( * ) Notice: Subject to any disclaimer, the term of this patent is extended or adjusted under 35 U.S.C. 154(b) by 270 days.

(21) Appl. No.: 12/050,051

(22) Filed: Mar. 17, 2008

(65) Prior Publication Data

US 2009/0230030 A1 Sep. 17, 2009

(51) Int. Cl.
*B65H 5/00* (2006.01)

(52) U.S. Cl. ..... 271/2; 271/145

(58) Field of Classification Search ..... 271/145, 271/302, 2, 1

See application file for complete search history.

(56) References Cited

U.S. PATENT DOCUMENTS 4,518,160 A * 5/1985 Lambrechts et al. ..... 271/214
4,625,641 A * 12/1986 Jagosz et al. ..... 101/240
5,009,053 A * 4/1991 Langenbeck et al. ..... 53/58
5,494,276 A * 2/1996 Faber et al. ..... 271/113
5,503,388 A * 4/1996 Guenther et al. ..... 271/300
5,906,468 A * 5/1999 Vander Syde et al. ..... 414/403
5,934,666 A * 8/1999 Rabindran et al. ..... 271/148
5,947,468 A * 9/1999 McKee et al. ..... 271/210
5,993,132 A * 11/1999 Harres et al. ..... 414/416.04
6,503,044 B1 * 1/2003 Enenkel ..... 414/404
6,575,306 B1 * 6/2003 Schuster et al. ..... 209/706
6,601,847 B2 * 8/2003 Hendrickson et al. ..... 271/302
6,679,491 B2 * 1/2004 Luebben et al. ..... 271/150
6,719,519 B2 * 4/2004 Liehs ..... 414/419
6,840,513 B1 * 1/2005 Rabindran ..... 271/216
7,021,529 B2 * 4/2006 Enright et al. ..... 235/379
7,137,234 B2 * 11/2006 Caporali et al. ..... 53/433
7,195,236 B2 * 3/2007 Hillerich et al. ..... 271/2
7,467,792 B2 * 12/2008 Bittenbender et al. ..... 271/149
2003/0103838 A1 * 6/2003 Liehs ..... 414/403
2004/0100015 A1 * 5/2004 Baker et al. ..... 271/145
2006/0087068 A1 * 4/2006 Bittenbender et al. ..... 271/2
2006/0113362 A1 * 6/2006 Kara et al. ..... 229/120.02
2007/0201968 A1 * 8/2007 Good et al. ..... 414/265

* cited by examiner

*Primary Examiner* — Stefanos Karmis
*Assistant Examiner* — Howard Sanders
(74) *Attorney, Agent, or Firm* — Tarolli, Sundheim, Covell & Tummino LLP

(57) ABSTRACT

A mail justifier system including at least one bucket for holding a flat article and a plurality of ramps configured to contact the flat article through an opening defined on the bucket to raise the flat article to a desired level. A plurality of parallel rollers is configured to enter into the opening and contact the flat article. The parallel rollers rotate causing the flat article to move within the bucket from a first position to a second position.

14 Claims, 2 Drawing Sheets

IN-LINE JUSTIFIER FOR LETTER AND FLAT MAIL SORTER

BACKGROUND

1. Field

The present invention relates to mail sorting processes, and more particular to an in-line justifier system and associated method for justifying mail pieces in a mail sorting process.

2. Related Art

Generally a flat mail sorting machine uses one or more carrousels of mail buckets. Mail pieces are singulated by one or several feeders and injected into the mail buckets. Generally, the buckets are configured to drop mail into trays positioned directly below the buckets according to a mail sort plan. However, due to the variable position of the mail within the buckets the mail stack quality in the tray may be affected.

Several variables contribute to the position of the mail within the bucket, such as the bond of the mail in the injection area, the mail pieces injection into the bucket, the centrifugal force around the curves of the carousel, and the like. These variations in the lateral position of the mail in the bucket dictate where the mail piece may ultimately drop in the tray. The variations of the position of the mail piece within the tray creates challenges for controlling and potentially automating follow-on mail sorting processing of the mail piece in the tray.

SUMMARY

In one aspect, a mail justifier system is provided for use in a mail sorting process. The mail justifier system includes at least one bucket for holding a flat article and a plurality of ramps configured to contact the flat article through an opening defined on the bucket to raise the flat article to a desired level. A plurality of parallel rollers is configured to enter into the opening and contact the flat article. The parallel rollers rotate causing the flat article to move within the bucket from a first position to a second position.

In another aspect, a method is provided for justifying mail in a mail sorting process. The method includes providing at least one bucket for holding a flat article; and moving the flat article from a first unjustified position to a second justified position within the bucket.

As mail sorting equipment becomes more capable of sorting a wider spectrum of mail shapes and sizes, justification of mail in mail trays has become a more critical component of the stack quality. Since stack quality of mail pieces in trays is important to automated mail processing steps, the present invention provides a beneficial component of any mail sorter design The in-line justifier system of the present invention allows mail pieces to be stacked in a justified manner into mail trays. Moreover, the present invention allows for automated mail processing after sorting of the mail pieces, allows automated mail processing for multiple passes in a sorting machine and eases any manual operation of mail stack unloading for an operator.

The foregoing and other features and advantages of the invention will become more apparent from the following detailed description, which proceeds with reference to the accompanying figures.

BRIEF DESCRIPTION OF THE DRAWINGS

The features, objects, and advantages of the invention will become more apparent from the detailed description set forth below when taken in conjunction with the drawings, wherein.

DETAILED DESCRIPTION

The following description is exemplary in nature and is not intended to limit the scope, applicability, or configuration of the invention in any way. Various changes to the described embodiment may be made in the function and arrangement of the elements described herein without departing from the scope of the invention.

The justification of mail pieces is getting critical as the automation of mail processing is growing. For example, unloading a stack of mail pieces from a tray, changing the content from one tray to another, grouping mail pieces in new stacks, splitting mail pieces into smaller stacks, de-stacking and re-stacking mail pieces, are all automated operations that may require mail piece justification in order to be fully effective.

Later processing of mail pieces after being stacked in a tray, is made much easier if the mail pieces are stacked in a justified manner. Attempting to justify mail pieces after being randomly stacked is a much more difficult task than justifying a single mail piece at a time.

Figure 1:
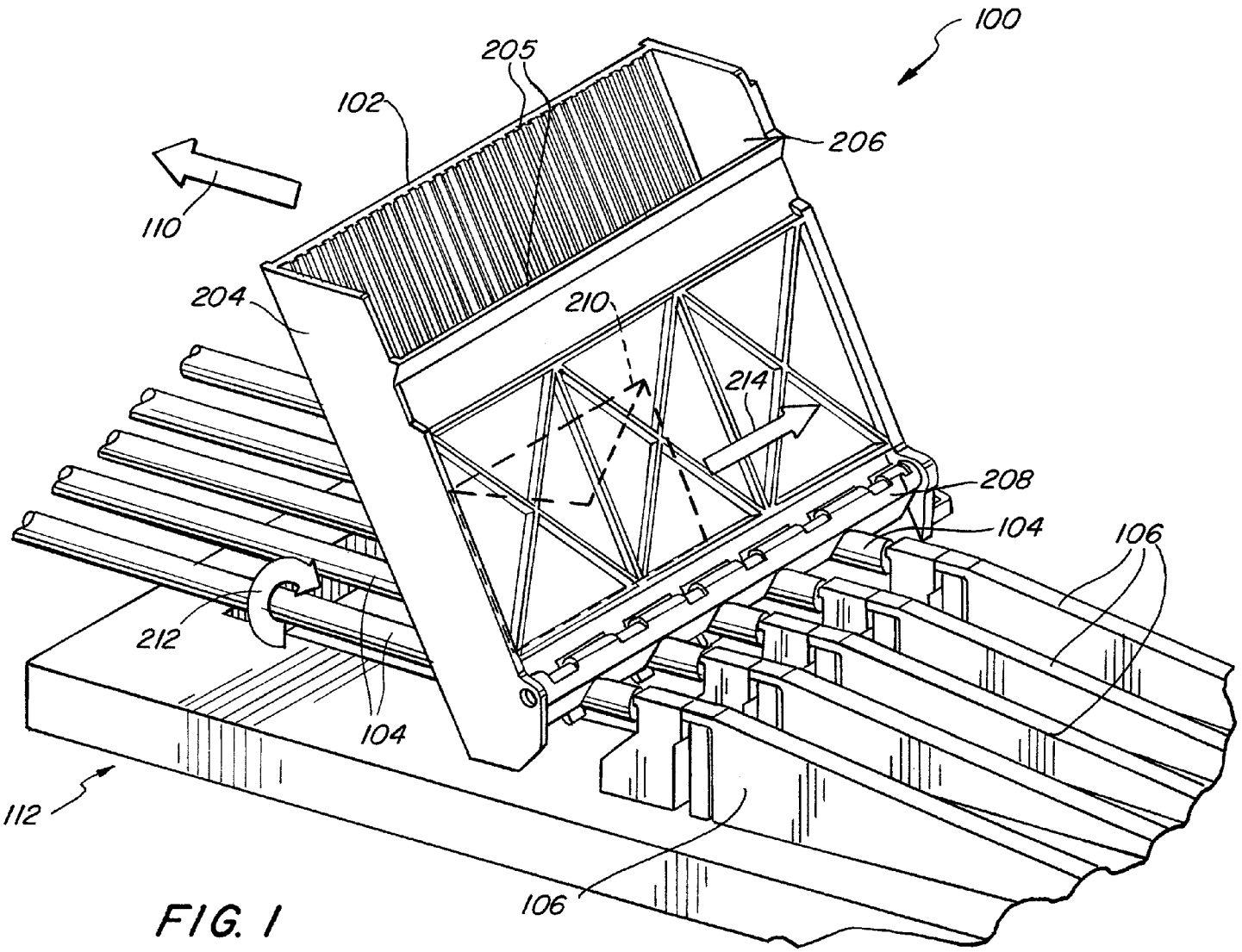
FIG. 1 is a perspective view of an in-line justifier system in accordance with an embodiment of the present invention.

FIG. 1 is a perspective view of in-line justifier system 100 in accordance with an embodiment of the present invention. In-line justifier system 100 includes a bucket assembly, which may include one to a plurality of buckets 102 coupled together as if to form a train of buckets 102. In-line justifier system 100 also includes a plurality of parallel rollers 104, and a corresponding plurality of ramps 106. Parallel rollers 104 each have an axis of rotation which is parallel to the direction of movement or conveyance (arrow 110) of buckets 102 along a carousel 112. Carousel 112 is operable to convey the bucket assembly on parallel rollers 104 in a manner known the industry.

As shown in FIG. 1, each bucket 102 of the bucket assembly includes bucket side wall 204, front and back walls 205, and a justification wall 206 all combined to define a top opening and a bottom opening. Bucket 102 is configured to hold a flat article, such as a mail piece 210, within the four walls of the bucket. Because bucket 102 is a location in which mail piece 210 is isolated in the mail process, bucket 102 is a prime location to justify mail piece 210.

Bucket 102 also includes a bucket flap 208, located at a bottom end of each bucket 102, which provides a closure for the bottom opening. Bucket flap 208 may be "opened" to expose the bottom opening, which allows parallel rollers 104 to pass through and make contact with mail piece 210 in bucket 102. Each parallel roller 104 may be centered to the bottom opening created by rotating bucket flap 208 away from the bottom opening of bucket 102.

Ramps 106 are located directly adjacent and in-line with each parallel roller 104. Ramps 106 contact bucket flap 208 and cause it to open and expose the bottom opening. Ramps 106 may then contact each mail piece 210 in order to raise each mail piece 210 from the bottom of bucket 102 to a first level corresponding to the top of parallel rollers 104.

Parallel rollers 104 continuously rotate (arrow 212) as bucket 102 is conveyed in direction 110 by carousel 112 through the mail sorting processes.

Upon contact with mail piece 210, the rotation 212 of each parallel roller 104 causes mail piece 210 to move within bucket 102, tangent (arrow 214) to the direction of rotation 212. Mail piece 210 moves from a first position, where mail piece 210 is free from contact with a surface of justification wall 206 to a second position, where mail piece 210 is in contact with the surface of justification wall 206. Alternatively, bucket 102 may be configured with an alternative justification surface different from justification wall 206. The alternative justification surface may be any surface disposed within bucket 102 provided to halt the lateral movement of mail piece 210 within bucket 102 for justifying mail piece 210.

In one embodiment, parallel rollers 104 are powered to a speed that provides synchronicity with the movement of bucket 102, which minimizes mail damage that may otherwise be caused by mail piece 210 moving over the rotating parallel rollers 104.

Figure 2:
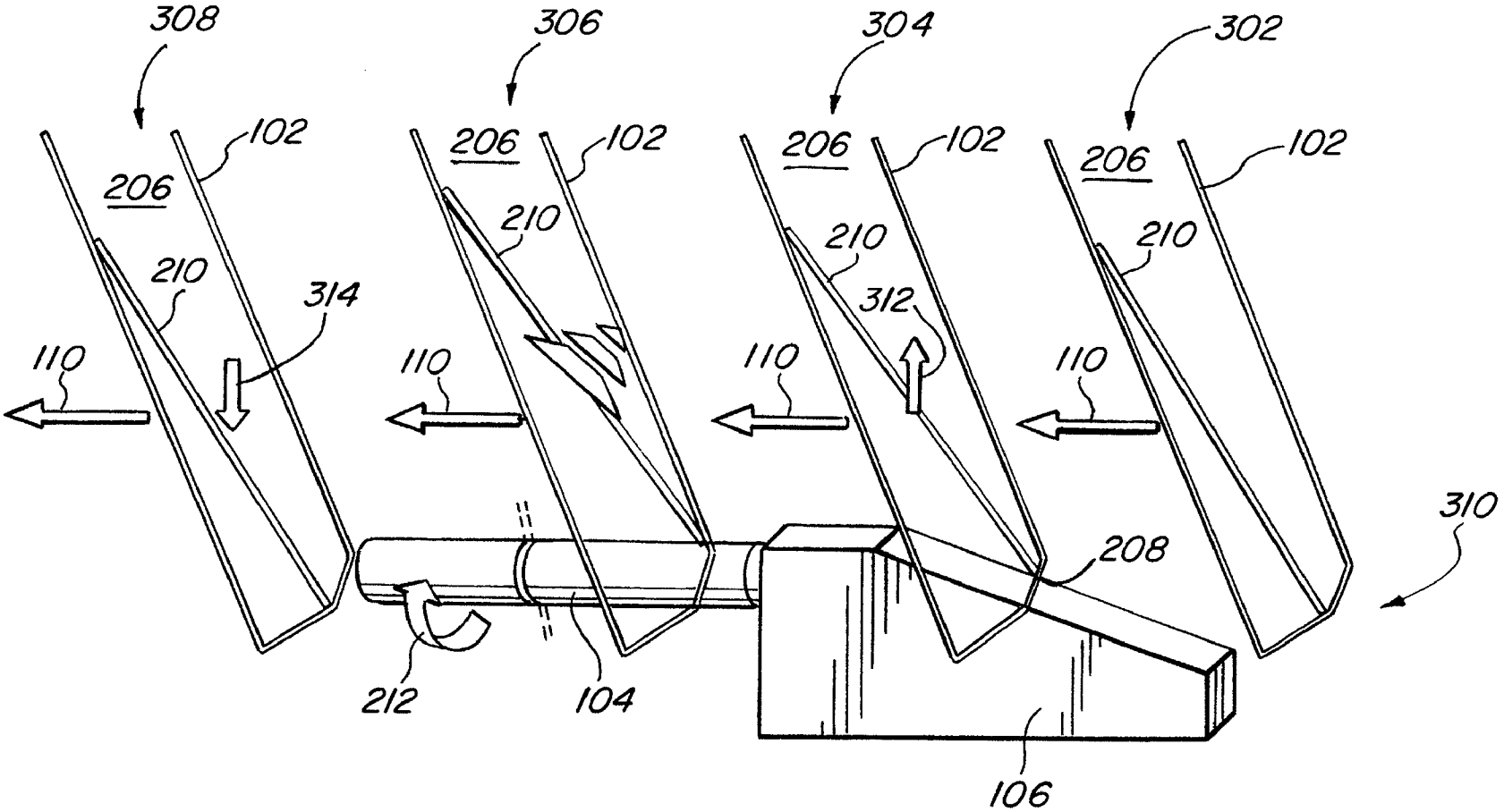
FIG. 2 is a simplified side view of the phases of operation of a single bucket of the in-line justifier system of FIG. 1 in accordance with an embodiment of the present invention.

FIG. 2 is a simplified side view of the phases of operation 302, 304, 306, and 308 represented by a single bucket 102 of in-line justifier system 100 in accordance with an embodiment of the present invention. In operation, in phase 302 bucket 102 is conveyed by carousel 112 along direction 110 in the mail sorting process (FIG. 1). Typically, mail piece 210 is positioned at the bottom end 310 of bucket 102 somewhere between bucket side wall 204 and justification wall 206.

In phase 304, as bucket 102 progresses along direction 110, bucket flap 208 is made to open allowing mail piece 210 to contact ramps 106. Ramps 106 raise mail piece 210 in direction 312 to a first level corresponding to the top of parallel rollers 104 to locate mail piece 210 onto the top of parallel rollers 104.

In phase 306, mail piece 210 makes contact with parallel rollers 104. The contact friction between mail piece 210 and parallel rollers 104 conveys mail piece in direction 214 tangent to the rotation 212 of parallel rollers 104 (into the page in FIG. 2). In one embodiment, the lateral movement of mail piece 210 within bucket 102 causes mail piece 210 to contact a surface of justification wall 206. In one embodiment, bucket flap 208 may include a corner flap (not shown) that facilitates the lateral mail motion by slightly pinching mail piece 210.

In phase 308, bucket flap 208 closes and mail piece 210 drops in direction 314 back to substantially the bottom 310 of bucket 102, flat and justified against the surface of justification wall 206, after leaving the end of parallel rollers 104. In this position mail piece 210 may be dropped, properly justified, and stacked to produce a justified stack of mail in the corresponding tray.

The invention has been disclosed in an illustrative manner. Accordingly, the terminology employed throughout should be read in an exemplary rather than a limiting manner. Although minor modifications of the invention will occur to those of ordinary skill in the art, it shall be understood that what is intended to be circumscribed within the scope of the patent warranted hereon are all such embodiments that reasonably fall within the scope of the advancement to the art hereby contributed, and that scope shall not be restricted, except in light of the appended claims and their equivalents.

What is claimed is:

1. A mail justifier system for use in a mail sorting process comprising:

at least one bucket for holding a flat article, said bucket having an opening;

a plurality of ramps configured to contact the flat article through the opening and raise the flat article; and a plurality of parallel rollers configured to enter into the opening and contact the flat article, the rotation of the parallel rollers causing said flat article to move from a first position to a second position within the bucket, wherein the bucket comprises a bucket flap which provides a closure to the opening, the bucket flap operable to open upon contact with the plurality of ramps.

2. The mail justifier system of claim 1, wherein the flat article comprises a mail piece.

3. The mail justifier system of claim 1, wherein the bucket comprises a justification wall, and wherein the second position comprises the flat article in a position to contact the justification wall.

4. The mail justifier system of claim 1, wherein the plurality of ramps raise the flat article to a first level, the first level corresponding to the top of the plurality of parallel rollers.

5. The mail justifier system for a mail sorter comprising:

at least one bucket for holding a flat article, said bucket defining a top opening and a bottom opening and having a flap operable to provide a closure for the bottom opening and a justification surface;

a plurality of ramps configured to open the flap to allow the flat article to contact the plurality of ramps through the bottom opening and raise the lowest part of the flat article to a first level; and a plurality of parallel rollers configured to enter into the bottom opening and contact the flat article at its lowest part, the parallel rollers operable to rotate causing the flat article to move from a first position, where the flat article is not in contact with the justification surface to a second position where the flat article is in contact with the justification surface.

6. The mail justifier system of claim 5, wherein the flat article comprises a mail piece.

7. The mail justifier system of claim 5, wherein the first level corresponds to the top of the plurality of parallel rollers.

8. A mail justifier system for use in a mail sorting process comprising:

at least one bucket configured to hold a single flat article, the bucket comprising four sides, the bucket having an opening;

a plurality of ramps configured to contact the single flat article through the opening and raise the single flat article in a first direction; and a plurality of parallel rollers configured to enter into the opening and contact the single flat article, the rotation of the parallel rollers causing the single flat article to move in a second direction, orthogonal to the first direction, from a first position to a second position within the bucket.

9. The mail justifier system of claim 8, wherein the single flat article comprises a mail piece.

10. The mail justifier system of claim 8, wherein the at least one bucket comprises a justification wall, and wherein the second position comprises the single flat article in a position to contact the justification wall.

11. The mail justifier system of claim 8, wherein the plurality of ramps raise the single flat article to a first level, the first level corresponding to the top of the plurality of parallel rollers.

12. The mail justifier system of claim 8, wherein the at least one bucket comprises a bucket flap which provides a closure to the opening, the bucket flap operable to open upon contact with the plurality of ramps.

13. The mail justifier system of claim 8, wherein the at least one bucket encloses the single flat article, such that the opening of the at least one bucket is circumscribed by the four sides of the at least one bucket.

14. The mail justifier system of 8, wherein each of the plurality of parallel rollers has a cylindrical shape.

* * * * *